US007712511B2

(12) United States Patent
Ienaga et al.

(10) Patent No.: US 7,712,511 B2
(45) Date of Patent: May 11, 2010

(54) CASTING METHOD AND CASTING APPARATUS

(75) Inventors: Yuuichi Ienaga, Saitama (JP); Tadayoshi Tsukeda, Hokkaido (JP); Hitohisa Yamada, Hokkaido (JP); Masahiko Muro, Hokkaido (JP); Yasuhiro Aoki, Hokkaido (JP)

(73) Assignees: The Japan Steel Works, Ltd., Tokyo (JP); Honda Motor Co., Ltd., Tokyo (JP)

( * ) Notice: Subject to any disclaimer, the term of this patent is extended or adjusted under 35 U.S.C. 154(b) by 301 days.

(21) Appl. No.: 11/883,772

(22) PCT Filed: Mar. 15, 2006

(86) PCT No.: PCT/JP2006/305162

§ 371 (c)(1),
(2), (4) Date: Aug. 6, 2007

(87) PCT Pub. No.: WO2006/098382

PCT Pub. Date: Sep. 21, 2006

(65) Prior Publication Data

US 2008/0169078 A1 Jul. 17, 2008

(30) Foreign Application Priority Data

Mar. 15, 2005 (JP) ..... 2005-072732

(51) Int. Cl.
*B22D 13/02* (2006.01)
*B22D 27/08* (2006.01)

(52) U.S. Cl. ..... 164/71.1; 164/114; 164/260; 164/286

(58) Field of Classification Search ..... 164/71.1, 164/260, 114–116, 286
See application file for complete search history.

(56) References Cited

U.S. PATENT DOCUMENTS 2,116,367 A 5/1938 Smith

FOREIGN PATENT DOCUMENTS

| | | | |
|---|---|---|---|
| EP | 0 293 961 | A1 | 12/1988 |
| GB | 1 472 288 | A | 5/1977 |
| JP | 55-126345 | A | 9/1980 |
| JP | 2000-343204 | A | 12/2000 |
| JP | 2002-331352 | A | 11/2002 |
| JP | 2002-331354 | A | 11/2002 |

*Primary Examiner*—Kuang Lin
(74) *Attorney, Agent, or Firm*—Birch, Stewart, Kolasch & Birch, LLP

(57) ABSTRACT

The present invention relates to a casting mold having a molten metal received therein which is rotated in one direction by a rotary device with the vertical axis as a rotary axis while solidifying the molten metal for a predetermined period of time, and, after the predetermined period of time is lapsed, the casting mold is rotated in the direction opposite the direction of rotation for a predetermined period of time, and the rotation in the opposing directions is repeated so that the molten metal is solidified. The molten metal can be shaken and agitated without roughening the surface of the molten metal to uniformalize the distribution of temperature of the molten metal in the casting mold.

14 Claims, 10 Drawing Sheets

RELATED METHOD

ROTARY AGITATING METHOD

CASTING METHOD AND CASTING APPARATUS

TECHNICAL FIELD

This invention relates to a casting method and casting apparatus suitable for casting an alloy which is subject to segregation during solidification.

BACKGROUND ART

For alloys which are subject to weight segregation due to incorporation of additive elements having a great difference in specific gravity or alloys containing elements which are segregation during solidification, it has been desired to effectively prevent occurrence of segregation during casting in order to improve product quality. In particular, Mg alloys and other light alloys are subject to the aforementioned segregation.

Referring to segregation of alloying elements that occurs during casting, a method can be proposed which includes lowering a casting temperature in order to reduce a time required until solidification, eliminate crystal growth or prevent phases having a high specific gravity or elements having a great atomic weight from settling. However, in actual casting, fluidity of molten metal in a thick shape or complicated shape must be taken into account. Thus it is difficult to substantially lower the casting temperature. Further, in a simple shape such as ingot, the casting temperature can be lowered. However, such a material is normally thick and thus needs a long solidification time even if the casting temperature is somewhat lowered. Thus, segregation occurs inevitably.

Besides this method, a method has been proposed which comprises eliminating segregation or finely dividing texture during casting to indirectly eliminate segregation (e.g., Patent Documents 1, 2).

The method disclosed in Patent Document 1 is a casting method which comprises effecting solidification in a horizontal direction in a directional solidification furnace having a chilling plate and a heating furnace while being slowly rotated on a horizontal axis. Thereby, casting defectives such as shrinkage cavity and segregation are eliminated while providing a sufficient temperature gradient.

Further, the method disclosed in Patent Document 2 is a casting method which comprises repeating mincingly rotation/reversed rotation or rotation in one direction and suspension of rotation of a casting mold placed on a chilling plate (water-cooling plate) so that a horizontal vibration is given to the casting mold in order to produce a fine regular system structure.

Patent Document 1: JP-A-2000-343204

Patent Document 2: JP-A-2002-331354

DISCLOSURE OF THE INVENTION

Problems that the Invention is to Solve

However, the casting method disclosed in Patent Document 1 is a method capable of producing cast free of cast defectives such as shrinkage cavity only when a high temperature gradient is given by using an expensive device including a chilling plate and a heating furnace. Thus, it may be difficult to apply this method to casting of ordinary low cost light alloys. Further, this method is to rotate the casting mold very slowly such that directional solidified structure and monocrystalline structure cannot be destroyed. Thus, this method is only effective when solidification speed is very low in such a case that solidifying the casting mold while heating the casting mold. However, this method cannot exert its effect on ordinary casting.

Further, the casting method disclosed in Patent Document 2 is a method which keeps a soundness of the casting material by using a chilling plate and a heating furnace as in Patent Document 1 in order to eliminate microporosity and thus requires the occupation of this device over an extended period of time. Thus, this method increases in cost. Moreover, when this temperature gradient is vertically great, it is very likely that vertical formulation segregation can occur although an effect of finely dividing the casting material can be exerted. Besides these methods, a method has been proposed which agitates the molten metal using an electromagnetic agitator to homogenize the molten metal. However, this method is disadvantageous in that it requires a huge equipment investment that adds to production cost.

The present invention has an object of providing a casting method and casting apparatus capable of giving a sufficient agitating force to molten metal without requiring the aforementioned cost of facilities, steps, etc. and hence preventing segregation to obtain a cast having an excellent quality. Another object of the present invention is to prevent the coarsening of the crystalline texture. In particular, the present invention has an object of providing a casting method and casting apparatus most suitable for the production of cast subject to segregation or ingot to be plastically worked (extrusion or forging/rolling).

Means for Solving the Problems

In other words, the casting method of the present invention comprises: rotating a casting mold having a molten metal received therein in one direction on a vertical axis as a rotary shaft for a predetermined period of time while solidifying the molten metal; after lapsing the predetermined period of time, rotating the casting mold in a direction opposite to the one direction for a predetermined period of time; and repeating the rotations of the casting mold in opposing directions to solidify the molten metal.

Further, according to the casting method of the present invention, an inner surface of a riser portion of the casting mold has a shape of a non-rotating body.

Still further, according to the casting method of the present invention, the casting method further comprises providing an inner surface of the riser portion of the casting mold with an agitating portion prior to the reception of the molten metal, the agitating portion having a shape that provides the molten metal in the casting mold with an agitating force in accordance with a rotation of the casting mold.

Still further, according to the casting method of the present invention, an inner surface of a riser portion of the casting mold has a shape of a rotating body.

Still further, according to the casting method of the present invention, the rotations of the casting mold are effected at a peripheral speed of from 400 to 1,000 mm/sec on an outermost circumference of the molten metal, and rotation time for one direction of the rotations is 5 to 60 seconds.

Still further, according to the casting method of the present invention, the rotations of the casting mold in opposing directions begin when a temperature falls within a range of from not lower than a solidification starting temperature of the molten metal to not higher than (solidification starting temperature+200° C.), and the method continues the rotations until a solidification is completed.

Still further, a casting apparatus of the present invention comprises: a casting mold that receives and solidifies a molten metal; a rotary device that is capable of rotary driving the casting mold in opposing directions with a vertical axis as a rotary shaft; and a rotation controlling portion that controls the rotary device to repeat operations including: continuously rotate the casting mold at a predetermined rotary speed in one direction for a predetermined period of time; and after the predetermined period of time is lapsed, continuously rotate the casting mold at a predetermined rotary speed in a direction opposite to the one direction for a predetermined period of time.

Still further, according to the casting apparatus of the present invention, an inner surface of a riser portion of the casting mold is provided with an agitating portion having a shape that provides the molten metal in the casting mold with an agitating force in accordance with a rotation of the casting mold.

Still further, according to the casting apparatus of the present invention, the agitating portion includes a protrusion formed along the vertical direction on the inner surface of the riser portion.

Still Further, according to the casting apparatus of the present invention, the protrusion has an upper end high enough to protrude beyond a sprue.

Still further, according to the casting apparatus of the present invention, the protrusion is provided in a number of from one to four with an interval in a circumferential direction therebetween.

In other words, according to the present invention, by repeating the continuous rotation of the casting mold and the switch of the direction of rotation of the casting mold, the molten metal in the casting mold can be shaken without roughening the surface of the molten metal and is positively agitated. In this manner, distribution of temperature of the molten metal in the casting mold becomes uniform so that the temperature of the molten metal is uniform except the region in the vicinity of the wall of the casting mold, which is greatly affected by the cooling of the casting mold. Thus, the entire molten metal in liquid phase can be kept until the temperature thereof reaches close to the solidification starting temperature. Solidification does not begin soon after pouring but proceeds only when the temperature of the liquid crystal which has been continuously agitated falls and reaches close to the solidification starting temperature. Therefore, there is little time difference between solidification of the periphery and solidification of the central part, allowing solidification with extremely little segregates which can easily be concentrated to the final solidification site. Further, even when some segregation occurs, production of crystal nuclei is accelerated by the agitation and the size of crystalline texture becomes small. Hence, segregates produced at the grain boundary are divided more finely than ordinary, giving little effect of deteriorating strength. Moreover, not only the aforementioned segregation due to difference in melting point or degree of solid solution occurring at the grain boundary or between dendrites (branched crystal) but also weight segregation can be eliminated by the agitating effect and the solidification in a short period of time because solidification is effected with stirring to cause little settling of phase containing additive elements having a high atomic weight. Thus, by eliminating the texture which is partly low in the strength due to segregation, a good stable material having little strength dispersion can be produced. Further, secondary effects such as strength enhancement by fine division of crystal grains with agitation can be expected.

On the other hand, when no agitation is effected, the molten metal in the casting mold is given a temperature gradient from the periphery of the cast toward the central part of the cast, and the solidification is successively progressed shortly after pouring. Hence, difference in time required until the termination of solidification between the periphery and the central part thereof becomes large. Thus, as the molten metal solidifies slowly from the wall of the casting mold toward the central part of the casting mold, the texture becomes coarse. As a result, also due to prolonged solidification time, segregation is increased.

The aforementioned action normally has a greater effect as the casting material has a larger volume and thus needs a longer solidification time. When a casting material has a large volume, in order to efficiently agitate at a low rotary speed, the interior of the riser portion is preferably provided with an agitating portion given a shape allowing the agitation of the molten metal. The agitating portion may be arbitrary so far as the molten metal can be given an agitating effect and may be composed of raised portion, protrusion, agitating plate or the like. It is more effective that protrusions be provided along the vertical direction on the riser portion. The protrusions protrude beyond the liquid phase of the sprue by from about 10 mm to 25 mm after casting. Further, a plurality of the protrusions can be provided apart from each other at an interval in the circumferential direction. Preferably, the protrusions are provided in a number of one to four apart from each other at an equal angular interval. When the number of the protrusions increases, the agitating effect is eliminated. Therefore, the number of the protrusions is preferably four or less. The protrusions may be provided along the vertical direction. The protrusions may be provided obliquely to the vertical direction instead of vertical direction. The alignment of the protrusions is not limited to straight line.

Further, when the inner surface of the riser portion is in the form of a non-rotating body such as polygon, turbulence can easily occur in the interior of the riser portion when the casting mold is rotated, and agitating effect can be enhanced. On the other hand, the casting portion needs to cause entire flow and thus preferably has an inner surface in the form of a rotating body.

The rotation of the aforementioned casting mold is preferably effected at a peripheral speed of from 400 to 1,000 mm/sec on the outermost circumference of the molten metal and the time interval between the rotation in one direction and in the other direction is preferably from 5 to 50 seconds. When the aforementioned peripheral speed falls below 300 mm/sec, the molten metal in the vicinity of the wall of the casting mold, which is greatly affected by cooling, cannot be given a sufficient agitating effect. On the other hand, when a peripheral speed exceeding 1,500 mm/sec is given, the agitating effect is too great such that the surface of the liquid phase is roughened and hence defects such as cold shut and gas catch may occur. Thus, it is preferred that the casting mold be rotated at a speed falling within the aforementioned range. Further, when the time interval between the rotation in one direction and in the other direction falls below 5 seconds, the switch of direction of rotation is so frequent that sufficient rise in the flow rate cannot be obtained. On the other hand, when the time interval between the rotation in one direction and in the other direction exceeds 60 seconds, the molten metal continues to be rotated in a steady state such that it makes impossible to obtain the agitating effect efficiently. Accordingly, the aforementioned time interval of switching is thus desirable.

Further, the rotation of the casting mold preferably begins when the temperature falls within the range of from not lower than the solidification starting temperature to not higher than (solidification starting temperature+200° C.) and continues until the temperature reaches not higher than the solidification ending temperature. Since the effect of rotation of the casting mold is to uniformalize the composition and temperature distribution by agitation of the liquid phase portion, the rotation of the casting mold needs to be effected between shortly after the starting of solidification and the ending of solidification in which the liquid phase is eliminated. It is preferable to continue the rotation during this period. Referring to the timing of starting of rotation, rotation preferably begins at a time of pouring if possible, or at least before a time at which the casting portion reaches the solidification starting temperature. Referring to ending of rotation, when the rotation of the casting mold is terminated at a temperature higher than the solidification ending temperature, the distribution of temperature of the molten metal in the unsolidified region becomes ununiform such that segregation may be occurred. Thus, the rotation of the casting mold preferably continues until the temperature reaches a temperature lower than the solidification ending temperature.

The rotation of the casting mold and the switch of direction of rotation can be carried out by a rotation controlling portion which controls a rotary device composed of motor or the like. The rotation controlling portion can be composed of a control circuit, CPU which operates as programmed, etc.

The present invention is suitable for the casting of an alloy which is subject to weight segregation or segregation during solidification and can be applied particularly to Mg alloy containing zinc, rare earth metal, etc. or other light alloys. In particular, the present invention is suitable for thick cast or suitable for billet or ingot to be extruded, rolled or forged. However, the object to which the present invention can be applied is not limited to specific metallic materials but can be any metallic material which is advantageous when subjected to inhibition of segregation or fine division of texture.

Advantage of the Invention

As mentioned above, in accordance with the casting method of the present invention, a casting mold having a molten metal received therein is rotated in one direction with the vertical axis as a rotary axis while solidifying the molten metal for a predetermined period of time, and after the predetermined period of time is elapsed, the casting mold is rotated in the direction opposite the direction of rotation for a predetermined period of time, and the rotation in the opposing directions is repeated so that the molten metal is solidified. Thereby, production of segregates can be minimized and a fine homogenous structure can be obtained. Accordingly, it makes possible to obtain a metallic material excellent in ductility and strength.

Further, the casting apparatus of the present invention includes a casting mold for receiving and solidifying a molten metal, a rotary device capable of rotarily driving the casting mold in opposing directions with the vertical axis as a rotary axis and a rotation controlling portion for controlling the rotary device such that an operation of continuously rotating the casting mold at a predetermined rotary speed in one direction for a predetermined period of time, and after the predetermined period of time is elapsed, continuously rotating the casting mold at a predetermined rotary speed in the direction opposite the direction of rotation for a predetermined period of time is repeated. Thereby, the rotation of the casting mold can be controlled to assure the aforementioned effect.

DESCRIPTION OF REFERENCE NUMERALS

| | |
|---|---|
| 1 | Casting mold |
| 2 | Riser portion |
| 6 | Rotary device |
| 60 | Turn table |
| 61 | Motor |
| 7 | Rotation controlling portion |
| 8 | Agitating portion |
| 11 | Molten metal |

BEST MODE FOR CARRYING OUT THE INVENTION

Figure 1:
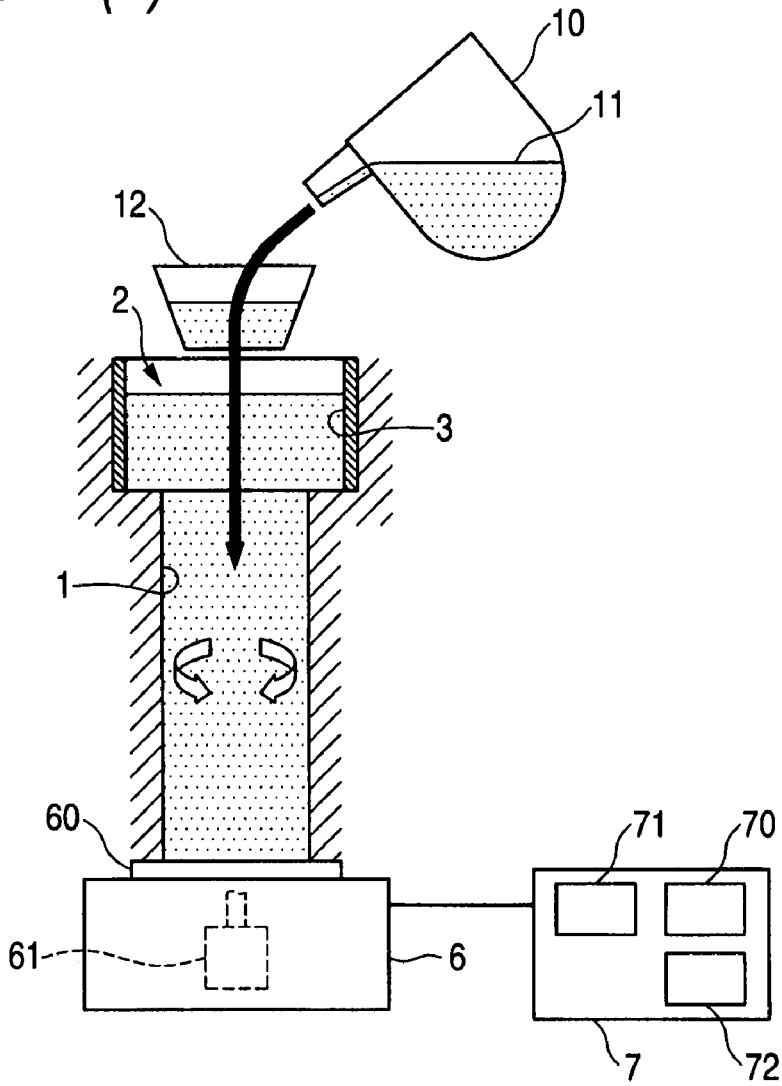
FIG. 1 is a schematic diagram illustrating a casting apparatus according to an embodiment of the present invention.
Figure 1:
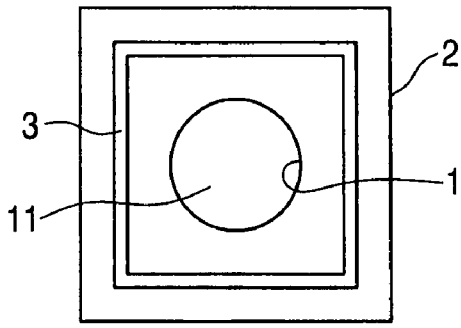

The casting apparatus of the present invention will be described hereinafter in connection with FIG. 1. FIG. 1(*a*) is a schematic diagram illustrating the casting apparatus of the present invention. FIG. 1(*b*) is a diagram of the casting mold 1 of the casting apparatus as viewed from above.

The cylindrical casting mold 1 has a box-shaped (rectangular cylinder) riser portion 2 having a great internal dimension formed on the upper part thereof. The riser portion 2 has a carbon plate 3 stuck to the inner surface thereof for preventing the occurrence of shrinkage cavity.

The aforementioned casting mold 1 is installed on a rotary device 6 covered by an insulating material or water-cooling structure member (not shown) and the casting mold 1 is capable of being rotated by the rotary device 6. The rotary device 6 is provided with a turntable 60 on which the casting mold 1 is installed, the turntable 60 has a motor 61 attached thereto via a gear (not shown) and the turntable 60 is rotarily driven by the motor 61. The motor 61 can be adjusted for rotary speed and switched in direction of rotation.

The rotary device 6 is connected to a rotation controlling portion 7 including, CPU70 and a driving circuit 71. Further, the rotation controlling portion 7 is provided with a setting portion 72 for setting the rotary speed of the casting mold and the interval between the rotation in one direction and the rotation in the other direction. The rotation controlling portion 7 is capable of preferably setting the rotary speed to from 0 to 100 rpm and the switch interval to from 1 to 300 seconds. The rotary speed setting portion may be arranged such that a proper value is inputted by operator's operation. The rotary speed setting portion may be arranged such that necessary data are previously stored in memories such as nonvolatile memory and HDD from which they are read out.

The operation of the aforementioned casting apparatus will be described hereinafter.

Firstly, Mg alloy or the like is melted in a smelting furnace 10 such as crucible, and the molten metal 11 is then poured into the casting mold 1 through a tundish 12. The molten metal 11 is received to a predetermined height in the riser portion 2. Subsequently, a control command is given by CPU 70 to the driving circuit 71 on the basis of a rotary speed and a rotation switch interval predetermined in the setting portion 72 and a control signal is given to the rotary device 6. In this manner, the rotary device 6 rotates the casting mold 1 according to the aforementioned control command. Inside the casting mold 1 which is being rotated at a proper rotary speed, an agitating effect is given such that the peripheral speed is from 400 to 1,000 mm/sec on the outermost circumference of the molten metal to uniformalize the temperature of the molten metal, and a proper turbulence occurs in the riser portion 2 to enhance the agitating effect. During this procedure, a proper rotary speed suppresses roughening of the surface of the liquid. Further, the direction of rotation of the casting mold 1 is switched at an optimum interval (5 to 60 seconds) shortly before the rotation of the casting mold 1. Therefore, the molten metal 11 can be effectively agitated the molten metal 11. In this manner, a cast having a finely divided and homogeneous structure with little segregation can be obtained.

Figure 2:
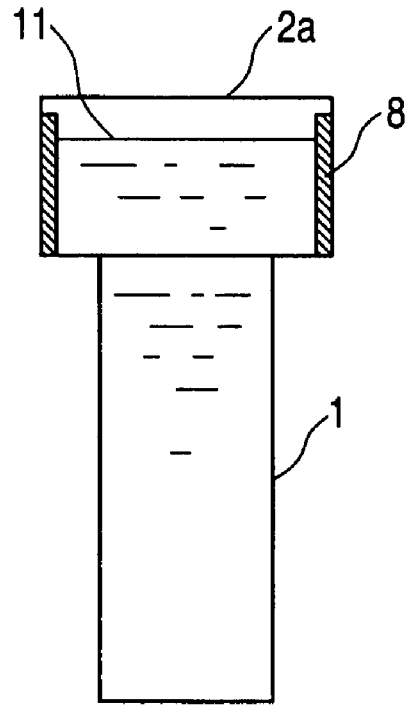
FIG. 2 is a schematic diagram illustrating a modification of the same casting apparatus as described above.
Figure 2:
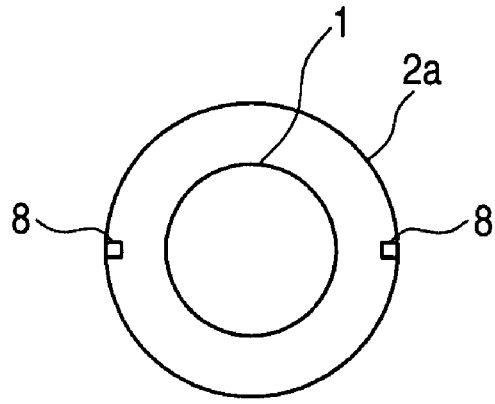

The aforementioned embodiment has no special structure provided on the inner surface of the riser portion. However, the riser portion 2*a* may have an agitating portion 8 provided on the inner surface thereof for giving an agitating effect to the molten metal 11 as shown in FIG. 2. FIG. 2(*a*) is a schematic diagram illustrating such a casting apparatus. FIG. 2(*b*) is a diagram of the casting mold 1 of the casting apparatus as viewed from above. The agitating portion 8 is formed as a protrusion (rib) extending longitudinally in this embodiment. Further, the upper position of the agitating portion 8 preferably protrudes beyond the surface of the liquid when the molten metal is received in the casting mold as shown in FIG. 2(*b*). The protrusions are preferably disposed in a number of from one to four apart from each other at an equal angular interval in the circumferential direction. However, the present invention is not limited to a specific number of protrusions.

EXAMPLE 1

(Preliminary Examination)

Figure 3:
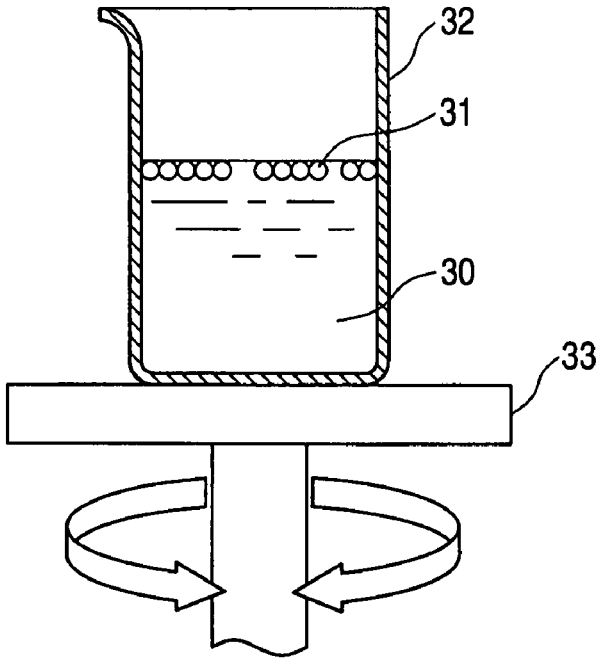
FIG. 3 is a schematic diagram illustrating the testing device used in the examples of the present invention.

Next, in order to confirm the effect of agitation by the present invention, a preliminary examination was made to observe the behavior of water in a beaker and wax particles (specific gravity: 0.99) suspended on the water. As shown in FIG. 3, a beaker 32 having 100 wax particles 31 suspended in water 30 was placed on a turntable 33, and then rotated the turntable 33.

Rotation of the turntable 33 was made at varying rotary speeds as set forth in Table 1 and the interval of reversal of rotation was constant (10 seconds).

Figure 4:
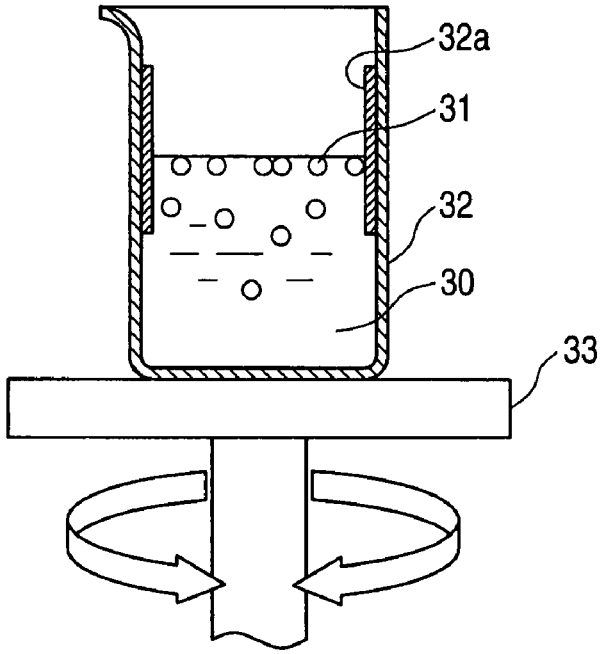
FIG. 4 is a schematic diagram illustrating a modification of the same testing device as used in the examples of the present invention.
Figure 5:
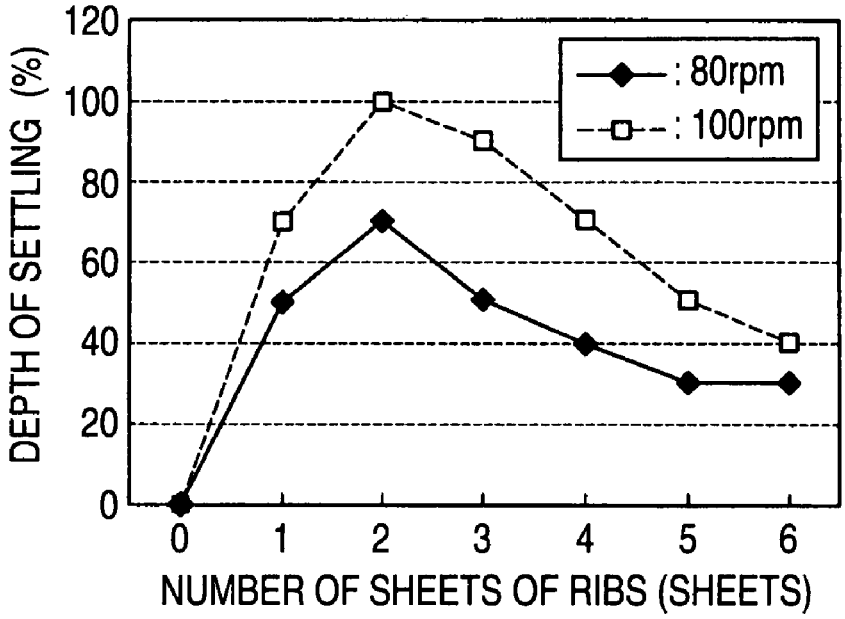
FIG. 5 is a graph illustrating the relationship between the number of ribs and the depth of settlement in the examples of the present invention.
Figure 6:
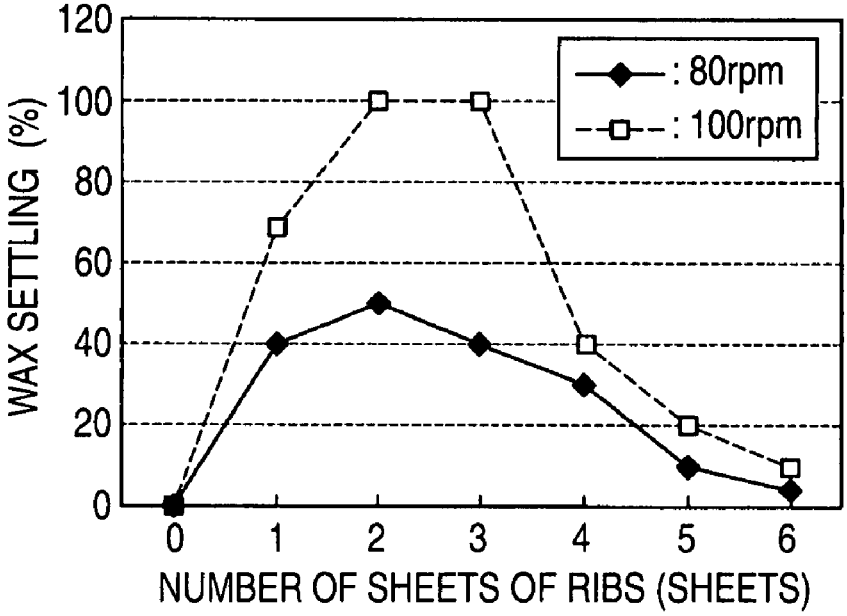
FIG. 6 is a graph illustrating the relationship between the number of ribs and the amount settled in the examples of the present invention.

As a result, by adding the reversal of rotation, a good agitating effect was obtained at a predetermined rotary speed. However, an agitating force great enough to cause the wax to sink is not obtained if the process is left as it is. Then, ribs 32*a* as shown in FIG. 4 were provided on the inner surface of the beaker 32 at a position close to the surface of the liquid. The behavior of the wax was observed with varying numbers of sheets of rib and rotary speeds. The depth of settling of wax which had sunk most deeply is shown in FIG. 5 with the depth from the surface of the liquid to the bottom as 100%. The ratio of the amount of wax which had sunk from the surface of the liquid to the total amount is shown in FIG. 6. As a result, the more the rotary speed was, the greater is the agitating force, and the agitating effect decreased when the number of sheets of rib increased or decreased from 2, which was a peak. Further, when rotation is reversed, the agitating force reaches maximum. However, when the rotary speed is increased excessively, water is shaken more, and the molten metal can be likely roughened on the surface thereof and scattered during the actual casting.

In the case of an actual large cast, rotation may be effected at a low rotary speed so far as the peripheral speed is on the same level. Sufficient effect can be exerted when rotation is effected at about 30 rpm for ϕ300 mm or at about 15 rpm for ϕ600 mm.

TABLE 1

* Results with no ribs

| Rotary speed (rpm) | 40 | 60 | 80 | 100 | 120 | 140 |
|---|---|---|---|---|---|---|
| One direction | X | X | X | X | Δ | Δ |
| Opposite direction | X | X | ○ | ▲ | ▲ | ▲ |

○: Wax particles rotated
Δ: Became steady after rotation
▲: Liquid surface roughened
X: Wax particles moved little On the basis of the aforementioned preliminary examination, an Mg—Zn-RE alloy was casted using a casting apparatus of the aforementioned embodiment.

A casting mold made of soft steel having an inner diameter ϕ of 300 mm and a height of about 1,000 mm was placed on the turntable. An Mg alloy was then melted in a smelting furnace. The alloying elements were adjusted to 6.67 wt % of Y, 4.91 wt % of Zn and 1.04 wt % of La (RE) as target. The solidification starting temperature and solidification ending temperature of the alloy having this formulation are about 630° C. and 500° C., respectively. The molten alloy was poured into the casting mold at a smelting temperature of 780° C. The turntable was rotated at 30 rpm (peripheral speed of 470 mm/sec on the outermost circumference) since shortly before pouring, and reversal of rotation was repeated every 35 seconds. After pouring, the casting mold was rotated for 10 minutes in total until the temperature of the casting mold reached about 470° C. The reversal of rotation was made in the shortest time at which the agitating force became steady, and the number of reversal of rotation was as many as possible until solidification. This is intended to cause vigorous agitation during reversal of rotation. Further, for comparison, casting involving no rotation was effected. The smelting method and the shape of the casting mold were the same as above. Referring to rotational condition 1, reversal was made immediately after 35 seconds, and this was repeated. Referring to rotational condition 2, rotation was suspended after 30 seconds, the molten metal was rotated by inertia for 5 seconds, reversal of rotation was made, and this was repeated.

Figure 7:
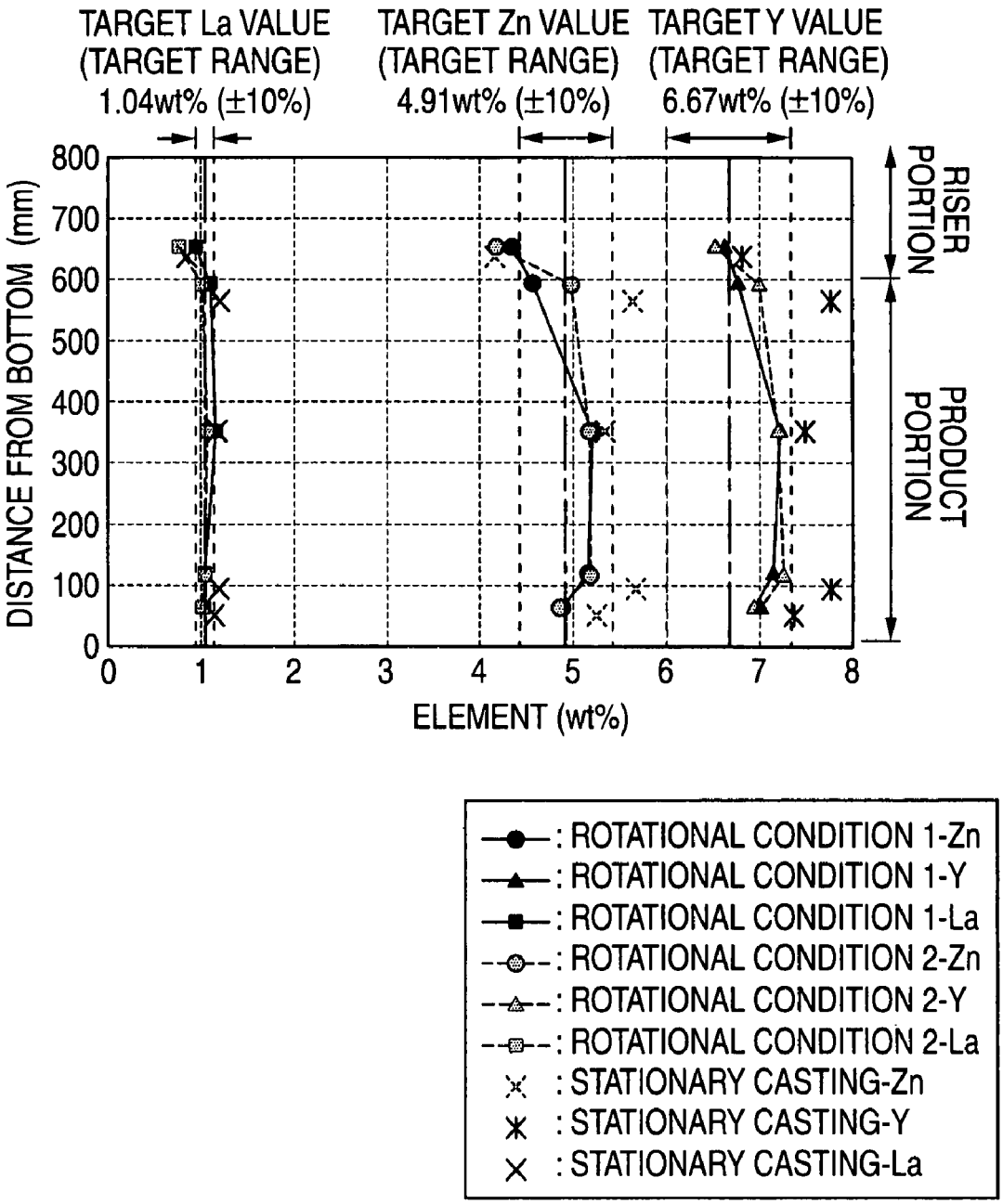
FIG. 7 is a diagram illustrating the distribution of chemical components of the casting material when the rotary state of the casting mold is varied in the examples of the present invention.

About one hour after casting, the casting mold was detached from the device, and the cast was then withdrawn from the casting mold for analysis of components. The results are shown in FIG. 7.

In the product portion, there are observed several stationary materials (symbol X) having components in an amount exceeding the target range. In contrast, materials which had been rotated have components in an amount falling within the target range and it is made obvious that a good formulation had been obtained. Referring to the width of dispersion, the ordinary stationary casting materials which had not been rotated showed a great dispersion, while those which had been solidified with stirring by rotation showed little variation width and became stable.

Figure 8:
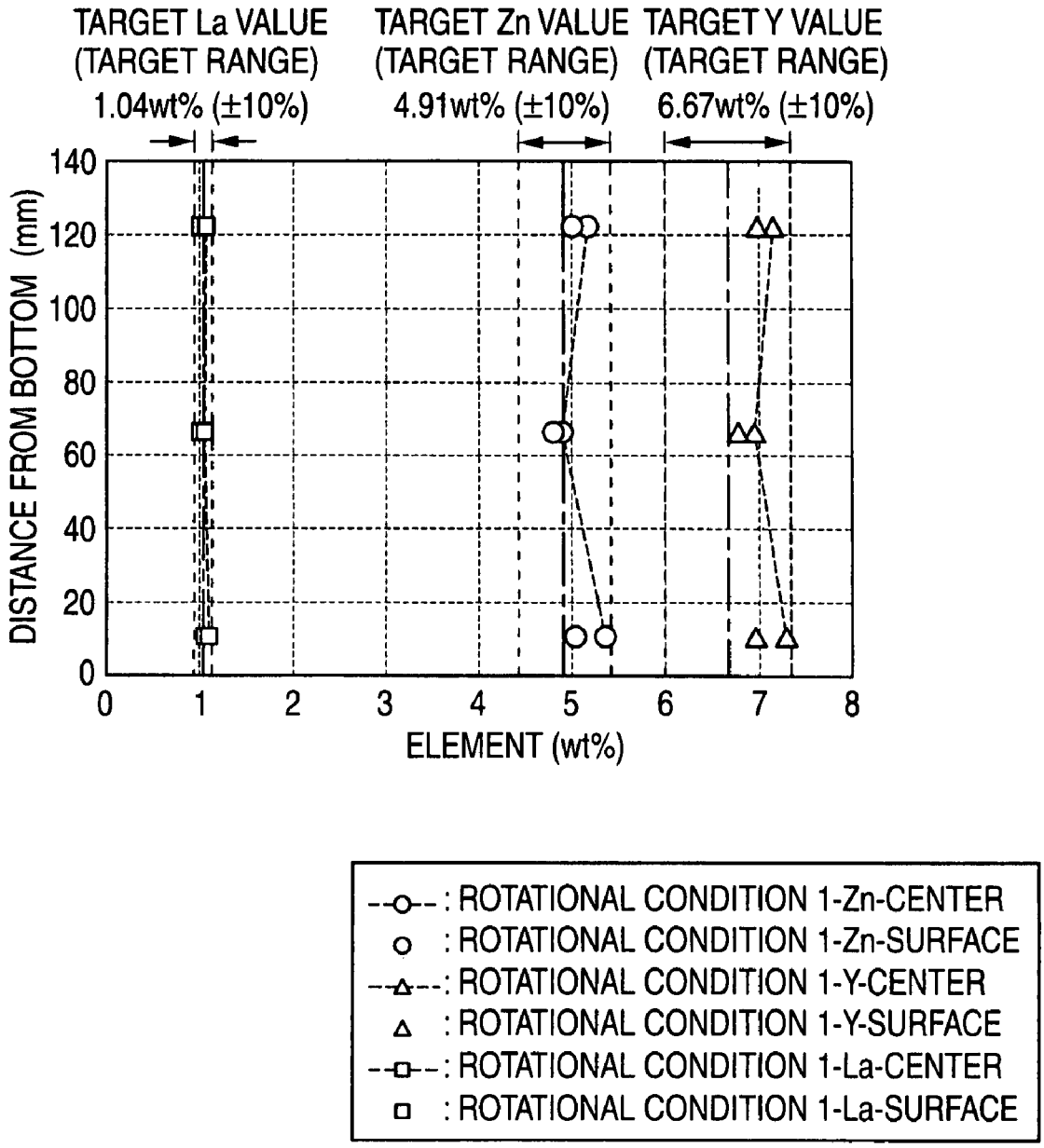
FIG. 8 is a diagram illustrating the vertical and radial distribution of chemical components of the casting material when the rotary state of the casting mold is varied in the examples of the present invention.
Figure 9:
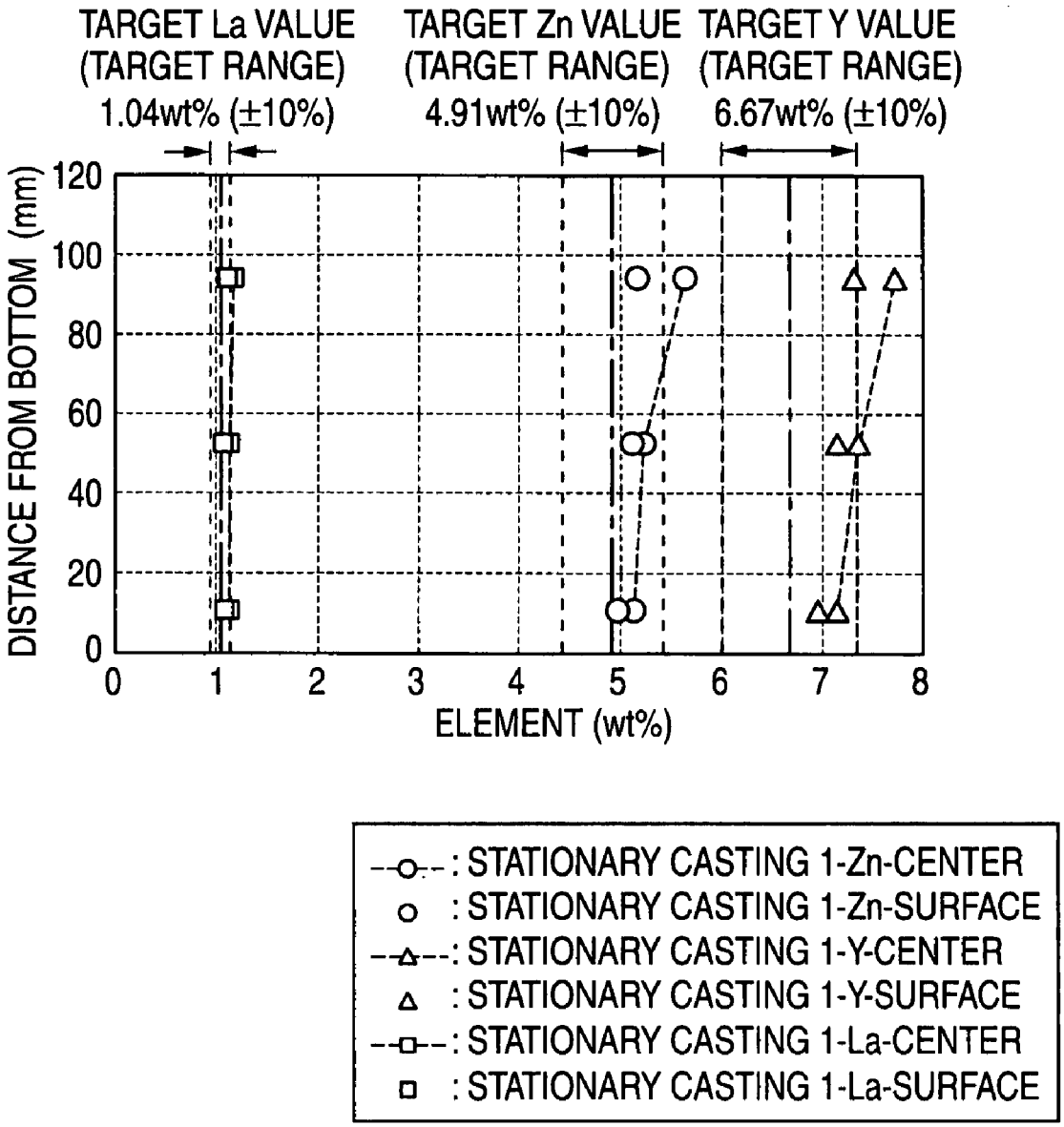
FIG. 9 is a diagram illustrating the vertical and radial distribution of chemical components of the related casting material which is not rotated.

Further, the difference in the formulation of the central part and in the radial direction on the surface between the casting materials which had been stirred by rotation and the stationary casting materials was also confirmed. These are shown in FIGS. 8 and 9. The rotary casting materials of FIG. 8 show formulation within the target range both in the vertical direction and in the radial direction of the cast. On the contrary, in the stationary casting materials of FIG. 9, the concentration of La, Zn and Y increase and deviate from the target range from the bottom of the cast toward the upper part thereof, at which solidification occurs late, and toward the radially central part thereof. Namely, the effect of agitation of the present invention is made obvious.

Figure 10:
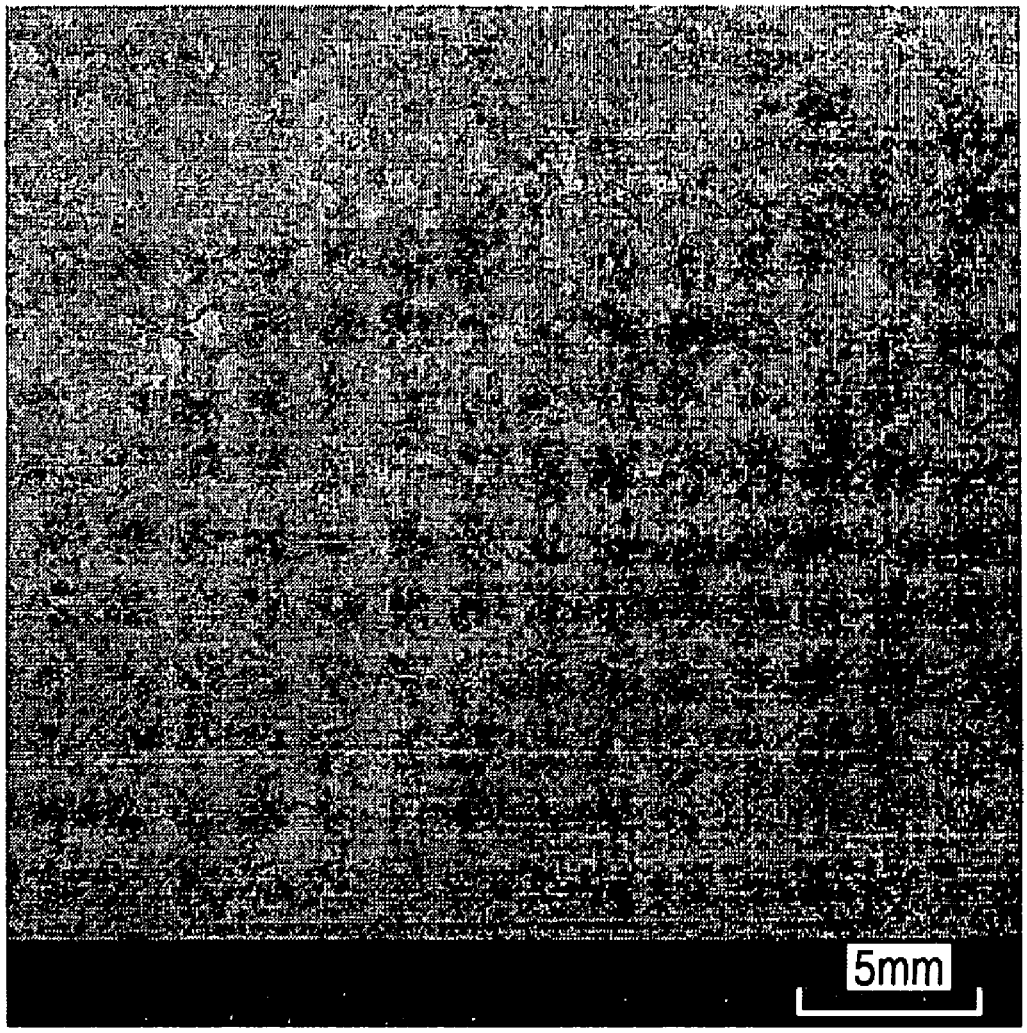
FIG. 10 is a photograph taken by observing the macrostructure of a cast of an inventive example.
Figure 11:
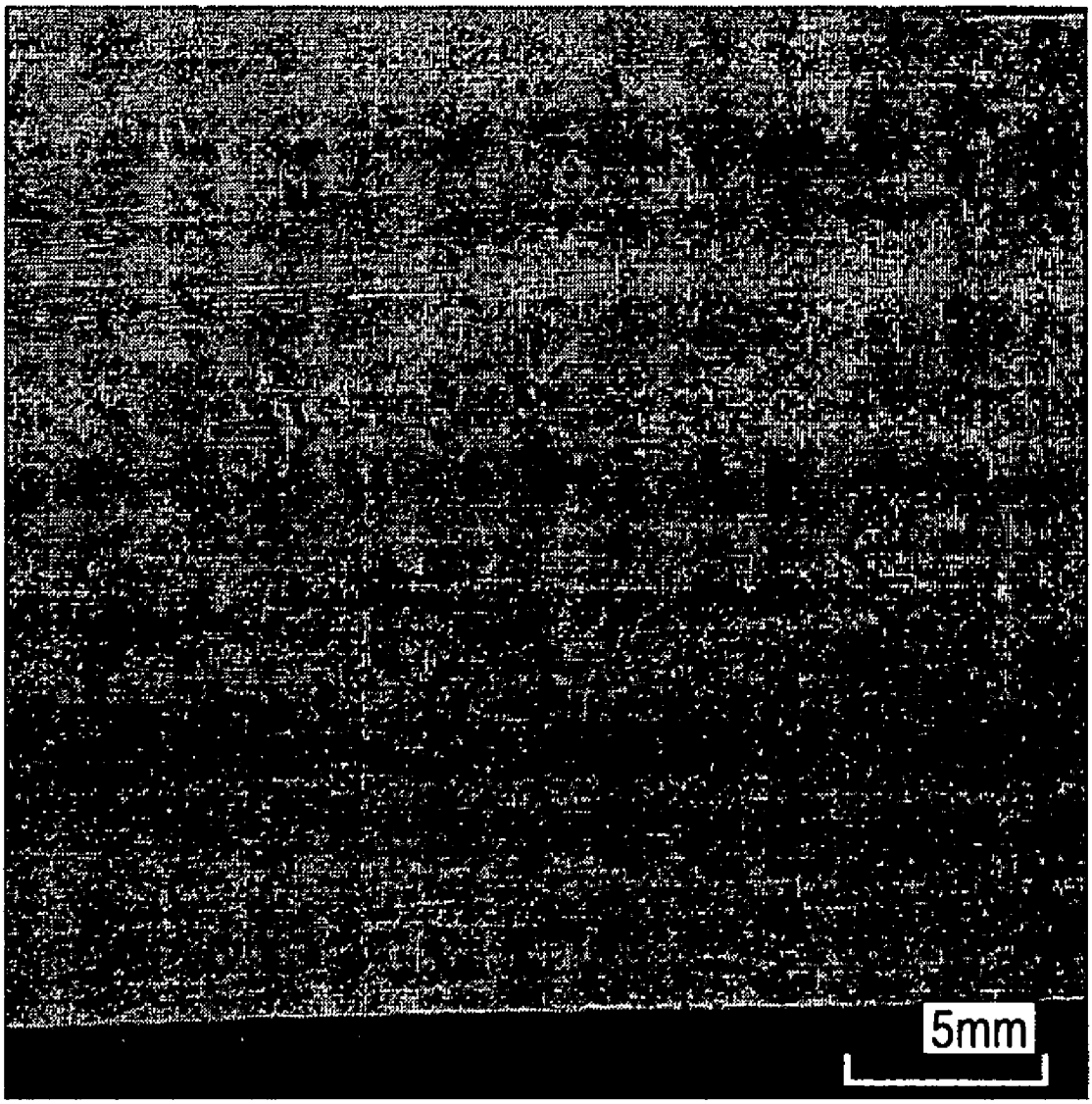
FIG. 11 is a photograph taken by observing the macrostructure of a cast of a related example.
Figure 12:
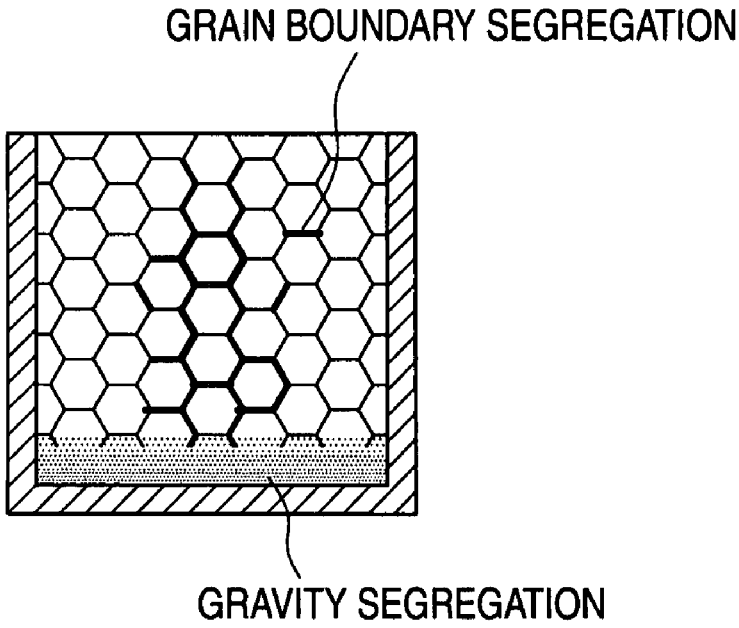
FIG. 12 is a view diagrammatically illustrating photographs taken by observing the macrostructure of casts of related example and inventive example.
Figure 12:
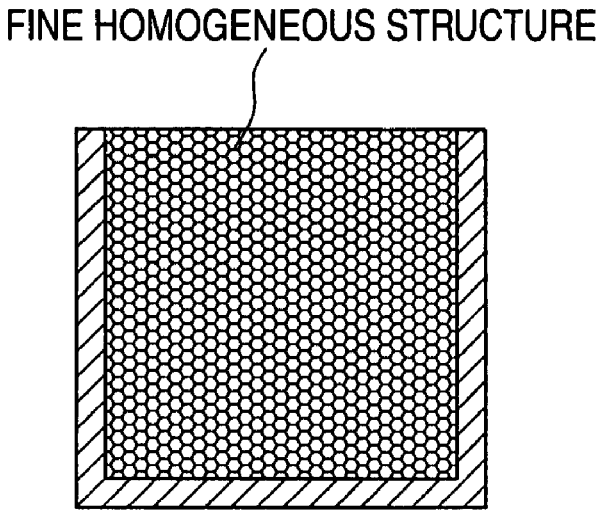

Further, the cast structure was also observed. As can be seen in the microphotograph of FIG. 10, the cast of an inventive example obtained with stirring by rotation under the rotational condition 1 has a homogeneous regular system structure. On the other hand, the cast of a comparative example obtained by stationary casting involving no agitation shows no regular system but a directional structure extending upward from the bottom as shown in the microphotograph of FIG. 11. Therefore, this cast shows a large crystal particle diameter and some gravity segregation and grain boundary segregation. Incidentally, FIG. 12 diagrammatically depicts the aforementioned microphotograph. FIG. 12(*a*) is a view diagrammatically illustrating the microphotograph of the cast of comparative example shown in FIG. 11. FIG. 12(*b*) is a view diagrammatically illustrating the microphotograph of the cast of inventive example shown in FIG. 10.

While the present invention has been described in detail and with reference to specific embodiments thereof, it will be apparent to one skilled in the art that various changes and modifications can be made therein without departing from the spirit and scope thereof.

The present application is based on Japanese Patent Application (JP-A-2005-072732) filed on Mar. 15, 2005 and its contents are hereby incorporated by reference.

INDUSTRIAL APPLICABILITY

In the casting method of the present invention, a casting mold having a molten metal received therein is rotated in one direction with the vertical axis as a rotary axis while solidifying the molten metal for a predetermined period of time, and after the predetermined period of time is elapsed, the casting mold is rotated in the direction opposite the direction of rotation for a predetermined period of time, and the rotation in the opposing directions is repeated so that the molten metal is solidified. Thereby, the production of segregates can be minimized and a fine homogenous structure can be obtained. Accordingly, it makes possible to obtain a metallic material excellent in ductility and strength.

Further, the casting apparatus of the present invention includes a casting mold for receiving and solidifying a molten metal, a rotary device capable of rotarily driving the casting mold in opposing directions with the vertical axis as a rotary axis and a rotation controlling portion for controlling the rotary device such that an operation of continuously rotating the casting mold at a predetermined rotary speed in one direction for a predetermined period of time and, after the predetermined period of time is elapsed, continuously rotating the casting mold at a predetermined rotary speed in the direction opposite the direction of rotation for a predetermined period of time is repeated. Thereby, the rotation of the casting mold can be controlled to assure the aforementioned effect.

The invention claimed is:

1. A casting method comprising:

rotating a casting mold having a molten magnesium metal received therein in one direction on a vertical axis as a rotary shaft for a predetermined period of time while solidifying the molten magnesium metal;

after lapsing the predetermined period of time, rotating the casting mold in a direction opposite to the one direction for a predetermined period of time; and repeating the rotations of the casting mold in opposing directions to solidify the molten magnesium metal, wherein an inner surface of a riser portion of the casting mold has a shape of a non-rotating body, and an inner surface of a casting portion of the casting mold has a shape of a rotating body.

2. The casting method according to claim 1, wherein the rotations of the casting mold are effected at a peripheral speed of from 400 to 1,000 mm/sec on an outermost circumference of the molten magnesium metal, and wherein rotation time for one direction of the rotations is 5 to 60 seconds.

3. The casting method according to claim 1, wherein the rotations of the casting mold in opposing directions begin when a temperature falls within a range of from not lower than a solidification starting temperature of the molten magnesium metal to not higher than (solidification starting temperature +200° C.), and wherein the method continues the rotations until a solidification is completed.

4. The casting method according to claim 1, wherein the inner surface of the riser portion of the casting mold has the shape of the non-rotating body, and the inner surface of the casting portion of the casting mold has the shape of the rotating body for providing the molten magnesium metal in the casting mold with an agitating force in accordance with a rotation of the casting mold.

5. The casting method according to claim 1, wherein the shape of a non-rotating body is a polygon, and wherein the shape of a rotating body is cylindrical.

6. A casting method comprising:

rotating a casting mold having a molten metal received therein in one direction on a vertical axis as a rotary shaft for a predetermined period of time while solidifying the molten metal;

after lapsing the predetermined period of time, rotating the casting mold in a direction opposite to the one direction for a predetermined period of time;

repeating the rotations of the casting mold in opposing directions to solidify the molten metal; and providing an inner surface of the riser portion of the casting mold with an agitating portion prior to the reception of the molten metal, the agitating portion formed as a protrusion extending longitudinally that provides the molten metal in the casting mold with an agitating force in accordance with a rotation of the casting mold, wherein an inner surface of a casting portion of the casting mold has a shape of a rotating body, and an inner surface of a riser portion of the casting mold has a shape of a rotating body.

7. The casting method according to claim 6, wherein the shape of a rotating body is cylindrical.

8. A casting apparatus comprising:

a casting mold that receives and solidifies a molten metal;

a rotary device that is capable of rotary driving the casting mold in opposing directions with a vertical axis as a rotary shaft; and a rotation controlling portion that controls the rotary device to repeat operations including:

continuously rotate the casting mold at a predetermined rotary speed in one direction for a predetermined period of time; and after the predetermined period of time is lapsed, continuously rotate the casting mold at a predetermined rotary speed in a direction opposite to the one direction for a predetermined period of time, wherein an inner surface of a riser portion of the casting mold has a shape of a non-rotating body, and an inner surface of a casting portion of the casting mold has a shape of a rotating body.

9. The casting apparatus according to claim 8, wherein the inner surface of the riser portion of the casting mold has the shape of the non-rotating body, and the inner surface of the casting portion of the casting mold has the shape of the rotating body for providing the molten metal in the casting mold with an agitating force in accordance with a rotation of the casting mold.

10. The casting apparatus according to claim 8, wherein the shape of a non-rotating body is a polygon, and wherein the shape of a rotating body is cylindrical.

11. A casting apparatus comprising:

a casting mold that receives and solidifies a molten metal;

a rotary device that is capable of rotary driving the casting mold in opposing directions with a vertical axis as a rotary shaft; and a rotation controlling portion that controls the rotary device to repeat operations including:

continuously rotate the casting mold at a predetermined rotary speed in one direction for a predetermined period of time; and after the predetermined period of time is lapsed, continuously rotate the casting mold at a predetermined rotary speed in a direction opposite to the one direction for a predetermined period of time, wherein an inner surface of a riser portion of the casting mold is provided with an agitating portion formed as a protrusion extending longitudinally that provides the molten metal in the casting mold with an agitating force in accordance with a rotation of the casting mold, and wherein an inner surface of a casting portion of the casting mold has a shape of rotating body, and an inner surface of the riser portion of the casting mold has a shape of a rotating body.

12. The casting apparatus according to claim 11, wherein the protrusion has an upper end high enough to protrude beyond a sprue.

13. The casting apparatus according to claim 11, wherein the protrusion is provided in a number of from one to four with an interval in a circumferential direction therebetween.

14. The casting apparatus according to claim 11, wherein the shape of a rotating body is cylindrical.

* * * * *